US012358671B2

(12) United States Patent
Ren

(10) Patent No.: US 12,358,671 B2
(45) Date of Patent: Jul. 15, 2025

(54) VACUUM SEALER

(71) Applicant: Zhongshan Xiaoshu Electrical Technology Co., Ltd., Zhongshan (CN)

(72) Inventor: Huasong Ren, Zhongshan (CN)

(73) Assignee: Zhongshan Xiaoshu Electrical Technology Co., Ltd., Zhongshan (CN)

( * ) Notice: Subject to any disclaimer, the term of this patent is extended or adjusted under 35 U.S.C. 154(b) by 49 days.

(21) Appl. No.: 18/422,877

(22) Filed: Jan. 25, 2024

(65) Prior Publication Data

US 2024/0327048 A1 Oct. 3, 2024

(30) Foreign Application Priority Data

Mar. 31, 2023 (CN) ..... 202320698047.4

(51) Int. Cl.
*B65B 31/02* (2006.01)
*B65B 7/02* (2006.01)
*B65B 51/14* (2006.01)

(52) U.S. Cl.
CPC ..... *B65B 31/024* (2013.01); *B65B 51/148* (2013.01); *B65B 7/02* (2013.01)

(58) Field of Classification Search
CPC ..... B65B 31/024; B65B 51/148; B65B 7/02; B65B 31/04; B65B 51/146
See application file for complete search history.

(56) References Cited

U.S. PATENT DOCUMENTS 3,764,434 A * 10/1973 Bridenstine ..... B29C 66/4312 156/251
7,000,369 B1 * 2/2006 Paviot ..... B65B 9/13 493/203

(Continued)

FOREIGN PATENT DOCUMENTS

CN 215323474 U * 12/2021 ..... B65B 31/04

*Primary Examiner* — Anna K Kinsaul
*Assistant Examiner* — Nicholas E Igbokwe
(74) *Attorney, Agent, or Firm* — Hawaii Patent Services; Nathaniel K. Fedde; Kenton N. Fedde

(57) ABSTRACT

A vacuum sealer, comprising an upper casing with a first vacuum contact surface, and a lower casing with a second vacuum contact surface, one side of the upper casing and one side of the lower casing are hinged together, wherein a projecting handle is provided at another side of the upper casing, a mount pad and a rotation shaft in contact with the handle are provided on the upper casing, the rotation shaft is installed rotatably on the mount pad via at least one positioning pad, the rotation shaft is connected with at least one guiding wheel, at least one projecting guiding block and at least one sliding chute are provided at another side of the at least one guiding wheel, the at least one sliding chute is provided in the at least one guiding wheel, one side of at least one locking hook is hinged on the at least one positioning pad, at least one positioning slot is provided in an intermediate portion of the at least one locking hook, at least one guiding block is inserted in the positioning groove, a first guiding shaft is provided on another side of the at least one locking hook, the first guiding shaft is plugged in the at least one sliding chute, at least one positioning hole is provided in the lower casing, when pressing the handle downward, the at least one guiding wheel and the at least one locking hook are driven to rotate so that a hook of the at least one locking hook is inserted into the at least one positioning hole and lock the upper casing and the lower casing together.

10 Claims, 7 Drawing Sheets

(56) References Cited

U.S. PATENT DOCUMENTS

| | | | | |
|---|---|---|---|---|
| 9,352,864 | B2 * | 5/2016 | Hammad | B65B 31/024 |
| 10,988,273 | B2 * | 4/2021 | Liang | B65B 51/10 |
| 2013/0097967 | A1 * | 4/2013 | Picozza | B65B 61/06 53/79 |
| 2013/0232925 | A1 * | 9/2013 | Huang | B65B 51/146 53/510 |
| 2014/0010589 | A1 * | 1/2014 | Hu | B65B 65/00 403/322.4 |
| 2015/0367973 | A1 * | 12/2015 | Owens | B65B 31/048 53/76 |
| 2021/0347508 | A1 * | 11/2021 | Li | B65B 51/148 |
| 2023/0211909 | A1 * | 7/2023 | Tsujimoto | B65B 31/00 53/88 |

* cited by examiner

VACUUM SEALER

INCORPORATION BY REFERENCE

This application claims priority to CN Application No. 2023206980474, filed Mar. 31, 2023, which is hereby incorporated by reference.

TECHNICAL FIELD

The present invention relates to a vacuum sealer.

BACKGROUND TECHNOLOGY

Chinese utility model patent no.: CN 215323474 U disclosed a vacuum sealer on Dec. 28, 2021, wherein the vacuum sealer comprises: a main body, comprising a first vacuum contact surface and two intermittently provided locking portions; a lid, provided with a second vacuum contact surface, wherein the second vacuum contact surface has a front side and a rear side opposite to each other, the lid and the main body are rotatably connected at the rear side; while rotating along with the lid against the main body, the second vacuum contact surface can engage with the first vacuum contact surface tightly and clamp a package to be sealed; a locking assembly, comprising a drive handle and two locking pieces; wherein the drive handle corresponds to an intermediate portion of the front side, and is rotatably connected with the lid; the two locking pieces are respectively located at both sides of the drive handle along the front side and are connected with the drive handle; the two locking pieces can move relative to the lid along with rotation of the drive handle relative to the lid, and engage with the locking portions one by one, so that the second vacuum locking surface and the first vacuum locking surface can be locked together to fasten the package to be sealed. This kind of vacuum sealer has a complex structure, and flexible open and close of such vacuum sealer is not available, which demands improvement.

SUMMARY OF THE INVENTION

The present invention aims to provide a vacuum sealer that can be opened and closed flexibly, to overcome the deficiencies in the prior art.

To this end, a vacuum sealer is designed, wherein the vacuum sealer comprises an upper casing with a first vacuum contact surface, and a lower casing with a second vacuum contact surface, one side of the upper casing and one side of the lower casing are hinged together, wherein a projecting handle is provided at another side of the upper casing, a mount pad and a rotation shaft in contact with the handle are provided on the upper casing, the rotation shaft is installed rotatably on the mount pad via at least one positioning pad, the rotation shaft is connected with at least one guiding wheel, at least one projecting guiding block and at least one sliding chute are provided at another side of the at least one guiding wheel, the at least one sliding chute is provided in the at least one guiding wheel, one side of at least one locking hook is hinged on the at least one positioning pad, at least one positioning slot is provided in an intermediate portion of the at least one locking hook, at least one guiding block is inserted in the positioning groove, a first guiding shaft is provided on another side of the at least one locking hook, the first guiding shaft is plugged in the at least one sliding chute, at least one positioning hole is provided in the lower casing, when pressing the handle downward, the at least one guiding wheel and the at least one locking hook are driven to rotate so that a hook of the at least one locking hook is inserted into the at least one positioning hole and lock the upper casing and the lower casing together.

Further, the at least one positioning pad comprises a second positioning pad and a third positioning pad, wherein the second positioning pad and the third positioning pad are respectively provided at both sides of the mount pad, axle holes for passing the rotation shaft are respectively provided in between the second positioning pad, the third positioning pad and the mount pad.

Further, at least one limiting slot communicating with the at least one positioning slot is provided at a rear side of the at least one positioning slot and an end of the at least one guiding block is abutted in the at least one limiting slot Further, a vent pad with one end thereof hinged on the mount pad is provided on the mount pad, an assembly slot is opened in an intermediate portion of the vent pad, the at least one guiding sleeve is sleeved over an intermediate portion of the rotation shaft, a limiting plate is provided at a side of the at least one guiding sleeve, the at least one guiding sleeve is rotatably provided in the assembly slot, the limiting plate is connected on the vent pad outside the assembly slot, another end of the vent pad is connected with at least one positioning spring provided on the mount pad, and a vent valve is provided underneath another end of the vent pad.

Further, a heating assembly and a first cushion are respectively provided at another side of the lower casing, a stopper for positioning an edge of a package to be sealed is provided at an inner side or an outer side of a first cushion; a silicone gel sealing piece and a second cushion are provided on a side of the upper casing, the first cushion corresponds to the second cushion; and the heating assembly corresponds to the silicone gel sealing piece.

Further, the handle and the rotation shaft are integrally formed by injection molding.

Further, the handle comprises an outer casing and an inner casing, wherein the inner casing of the handle is integrally formed with the rotation shaft by injection molding. Or, the handle comprises a base portion connected with the rotation shaft, and a hand lever connected with the base portion, at least one hole is provided in the base portion, at least one plug is inserted in the at least one hole, and the base portion and the rotation shaft are integrally formed by injection molding.

Further, the sliding chute is arc-shaped.

Further, the guiding block is triangular or rod-shaped.

Further, at least one auxiliary positioning seat is provided on the mount pad, at least one auxiliary positioning wheel is sleeved over an intermediate portion of the rotation shaft, the at least one auxiliary positioning wheel is connected with the at least one auxiliary positioning seat, and a side of the at least one auxiliary positioning wheel is provided with at least one locking slot; at least one locking boss is provided on the at least one auxiliary positioning seat, and the at least one locking boss is slidably inserted in the at least one locking slot.

In the present invention, a handle is provided on another side of the upper casing, the mount pad and the rotation shaft connected with the handle are provided in the upper casing, the rotation shaft is provided on the mount pad rotatably via the at least one positioning pad, the rotation shaft is connected with a side of the at least one guiding wheel, the at least one projecting guiding block and the at least one sliding chute are provided on another side of the at least one guiding wheel, the at least one sliding chute is provided outside the at least one guiding block, a side of the at least one locking hook is hinged on the positioning pad, at least one positioning slot is provided in the intermediate portion of the locking hook, the at least one guiding block is plugged in the positioning pad, another side of the locking hook is provided with a first guiding shaft, the first guiding shaft is inserted in the at least one sliding chute, at least one positioning hole is provided in the lower casing, by pressing the handle downwards the at least one guiding wheel and the locking hook are driven to rotate so that the locking hook is inserted into the at least one positioning hole and lock the upper casing and the lower casing together, the handle can drive the at least one guiding wheel and the locking hook to rotate flexibly, and delay or jamming is not liable to occur, open and close of the vacuum sealer is more flexible.

In the present invention, the vent pad with one end hinged on the mount pad is provided on the mount pad, the assembly slot is provided in an intermediate portion of the vent pad, the at least one guiding sleeve is sleeved on the intermediate portion of the rotation shaft, the limiting plate is provided on a side of the at least one guiding sleeve, the at least one guiding sleeve is rotatably provided in the assembly slot, the limiting plate is connected on the vent pad outside the assembly slot, another end of the vent pad is connected with at least one positioning spring located on the mount pad, a vent valve is provided underneath another end of the vent pad, when the at least one guiding sleeve rotates clockwise along with the rotation shaft, by contact of the limiting plate and the vent pad at a side of the positioning spring, another end of the vent pad can be pressed down so as to open the vent valve located underneath the vent pad; when the guiding sleeve rotates counterclockwise along with the rotation shaft, by contact of the limiting plate and the vent pad, one end of the vent pad can be pressed down so to close the vent valve located underneath the vent pad.

In the present invention, the at least one auxiliary positioning pad is provided on the mount pad, the at least one auxiliary positioning wheel is sleeved over the intermediate portion of the rotation shaft, the at least one auxiliary positioning wheel is connected on the at least one auxiliary positioning pad, at least one locking slot is provided at a side of the at least one auxiliary positioning wheel, at least one locking boss is provided on the at least one auxiliary positioning pad, the at least one locking boss is slidably interpolated in the at least one locking slot; by connecting the at least one locking slot of the at least one auxiliary positioning wheel and the at least one locking boss of the at least one auxiliary positioning pad, the handle can be maintained to be closed, when a user intends to use the present product, effort shall be spent to have the at least one locking slot of the at least one auxiliary positioning wheel leave the at least one locking boss of the at least one auxiliary positioning pad, and the security performance of the present product is improved.

Figure 1:
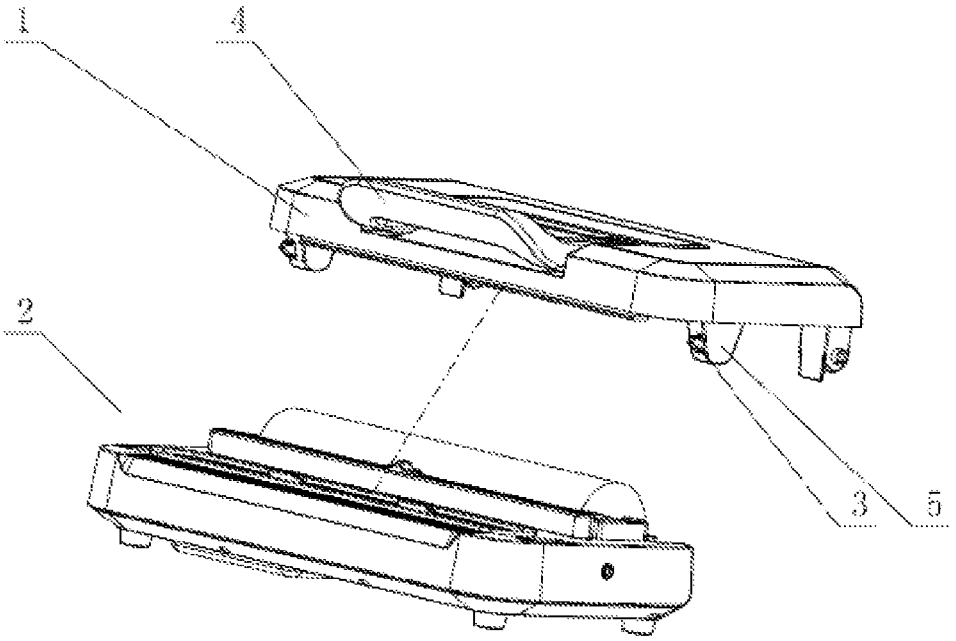
FIG. 1 is a structural diagram showing detached structures of an embodiment of the present invention.
Figure 2:
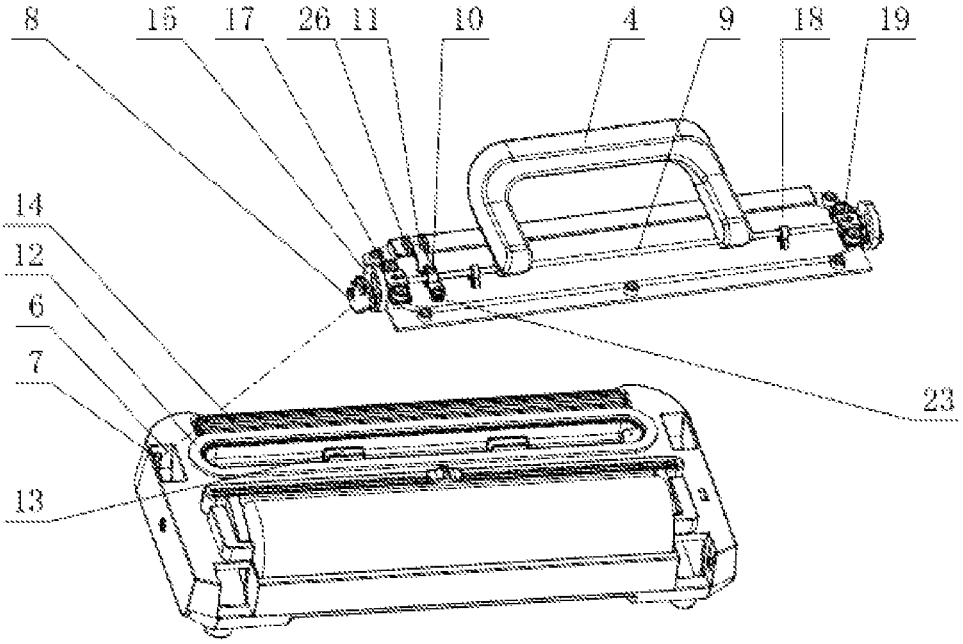
FIG. 2 is a structural diagram showing decomposed structures of a casing without an upper casing.
Figure 3:
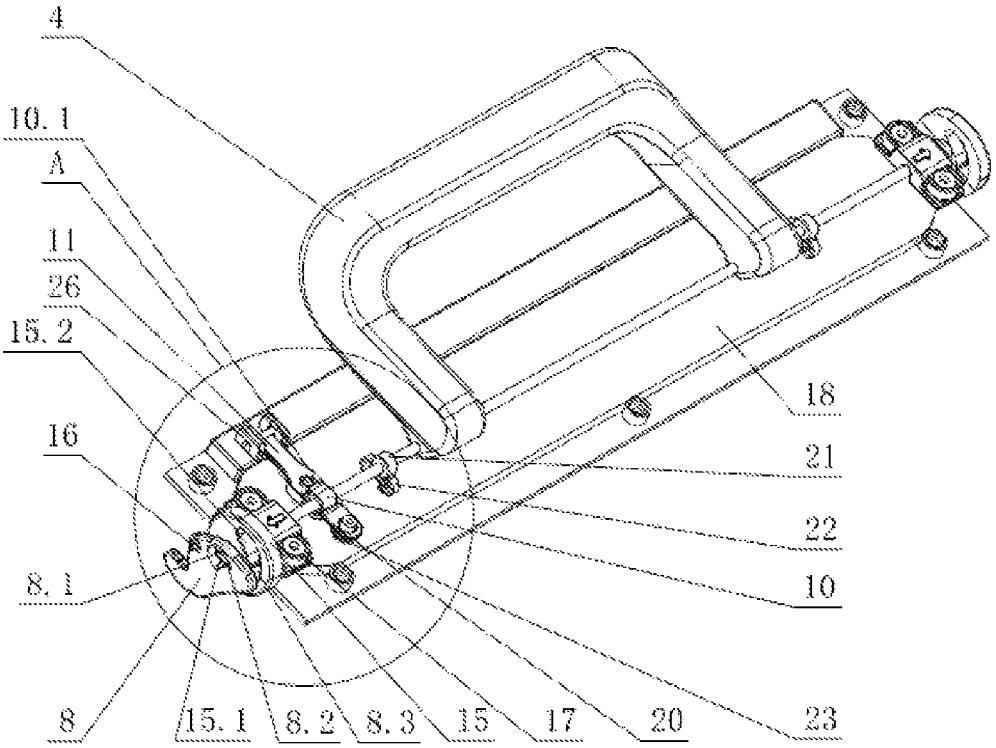
FIG. 3 is an enlarged structural diagram after assembling a handle and a rotation shaft.
Figure 4:
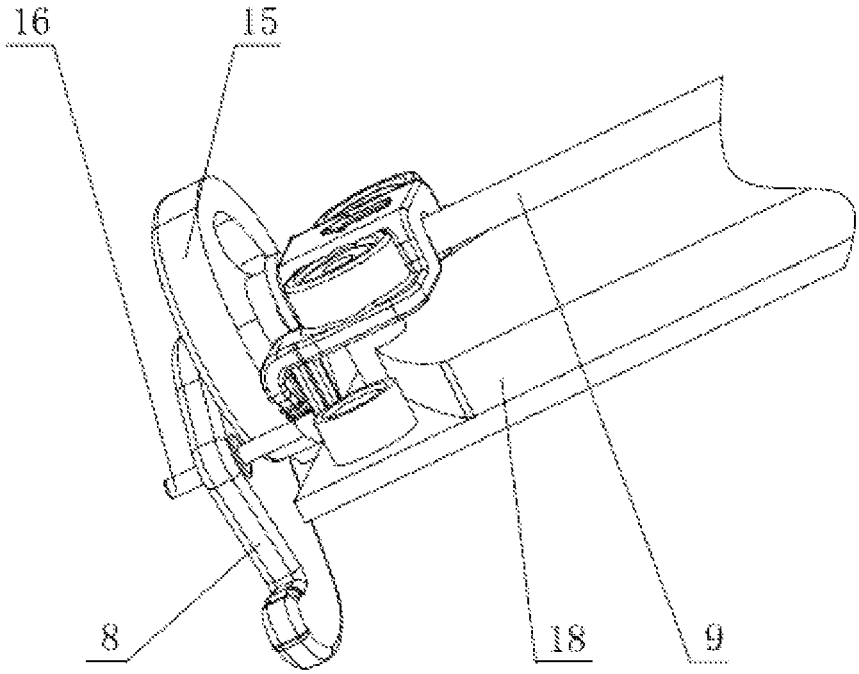
FIG. 4 is a locally enlarged structural diagram of a bottom view of FIG. 3.

In the drawings: 1 upper casing, 2 lower casing, 3 hook, 4 handle, 4.1 handle outer casing, 4.2 handle inner casing, 4.3 hand lever, 4.3.1 plug, 4.4 base portion, 5 pin, 6 slot, 7 positioning hole, 8 locking hook, 8.1 positioning slot, 8.2 limiting slot, 8.3 first guiding shaft, 9 rotation shaft, 10 guiding sleeve, 10.1 limiting plate, 11 vent pad, 12 first cushion, 13 stopper, 14 heating assembly, 15 guiding wheel, 15.1 guiding block, 15.2 sliding chute, 16 second guiding shaft, 17 second positioning pad, 18 mount pad, 19 third positioning pad, 20, assembly slot, 21 auxiliary positioning wheel, 22 auxiliary positioning pad, 23 positioning spring, 24 second cushion, 25 silicone gel piece, 26 support, and 30 protection sleeve.

EMBODIMENTS

Hereinafter a further description will be given to the present invention in conjunction with the drawings and the embodiments.

With reference to FIGS. 1-12, a vacuum sealer, comprising an upper casing 1 provided with a first vacuum contact surface and a lower casing 2 provided with a second vacuum contact surface, a side of the upper casing 1 and a side of the lower casing 2 are hinged together, a handle 4 is provided at another side of the upper casing 1, a mount pad 18 and a rotation shaft 9 connected with the handle 4 are provided in the upper casing 1, the rotation shaft 9 is rotatably installed on the mount pad 18 via at least one positioning pad, the rotation shaft 9 is connected with a side of at least one guiding wheel 15, another side of the at least one guiding wheel 15 is provided with at least one guiding block 15.1 and at least one with sliding chute 15.2, wherein the at least one sliding chute 15.2 is provided outside the at least one guiding block 15.1, a side of the locking hook 8 is inserted into a positioning slot 8.1, another side of the locking hook 8 is provided with a first guiding shaft 8.3, the first guiding shaft 8.3 is plugged in the sliding chute 15.2, at least one positioning hole 7 is provided in the lower casing 2, when pressing the handle 4 down, the at least one guiding wheel and the locking hook 8 are driven to rotate so that the locking hook 8 is plugged in the at least one positioning hole 7 and lock the upper casing 1 and the lower casing 2 together.

In the present embodiment, a vacuum pump is provided in the lower casing 2, and the vacuum pump belongs to existing technologies, and will not be repeatedly described here.

In the present embodiment, the upper casing comprises a lid and a bottom plate, the mount pad 18 is provided on the bottom plate, or, the mount pad 18 is integrally formed with the bottom plate.

During use, at least one pin 5 can be provided at a bottom portion of the bottom plate, the locking hook 8 is installed in the at least one pin 5, at least one slot 6 is provided in the lower casing, on a side surface of the at least one slot 6 is provided at least one positioning hole 7, wherein the locking hook 8 passes the at least one pin 5, when the at least one pin 5 is inserted into the at least one slot 6, a hook of the locking hook 8 is inserted into the at least one positioning hole 7, so as to lock the lower casing and the upper casing together.

The at least one positioning pad comprises a positioning pad 17 and a positioning pad 19, the second positioning pad 17 and the third positioning pad 19 are respectively provided on both sides of the mount pad 18, and axle holes for passing the rotation shaft 9 are respectively provided in between the second positioning pad 17, the third positioning pad 19 and the mount pad 18.

In the present embodiment, by providing respectively the second positioning pad 17 and the third positioning pad 19 stability during rotation can be promised.

At least one limiting slot 8.2 communicating with the at least one positioning slot 8.1 is provided at a rear portion of the at least one positioning slot 8.1 and an end of the at least one guiding slot 15.1 is abutted against the at least one limiting slot 8.2.

When the rotation shaft 9 drives an end portion of the at least one guiding block 15.1 to be abutted against a side surface of the at least one limiting slot 8.2, the at least one locking hook 8 is driven to rotate, and when the end portion of the at least one guiding block 15.1 leaves the at least one limiting slot 8.2, the at least one guiding block 15.1 can rotate in the at least one positioning slot 8.1 relative to the at least one positioning slot 8.1.

A vent pad 11 with one end hinged on the mount pad 18 is provided on the mount pad 18, an assembly slot 20 is provided at an intermediate portion of the vent pad 11, at least one guiding sleeve 10 is sleeved over an intermediate portion of the rotation shaft 9, at least one limiting plate 10.1 is provided at a side of the at least one guiding sleeve 10, the at least one guiding sleeve 10 is rotatably provided in the assembly slot 20, the at least one limiting 10.1 is pressed on the vent pad 11 outside the assembly slot 20, another end of the vent pad 11 is pressed on at least one positioning spring 23 provided on the mount pad, and a vent valve is provided underneath another end of the vent pad.

In the present embodiment, at least one support 26 is provided on the mount pad 18, and one end of the vent pad 11 is hinged on the at least one support 26.

A heating assembly 14 and a first cushion 12 are respectively provided on another side of the lower casing 2, at least one stopper 13 for locating an edge of a package to be sealed is provided at an inner side or an outer side of the first cushion 12. At least one silicone gel piece 25 and a second cushion 24 are provided at a side of the upper casing, the first cushion 12 and the second cushion 24 are correspondingly provided. The heating assembly 14 and the silicone gel piece 25 are correspondingly provided.

The handle 4 and the rotation shaft 9 are integrally formed by injection molding.

Figure 5:
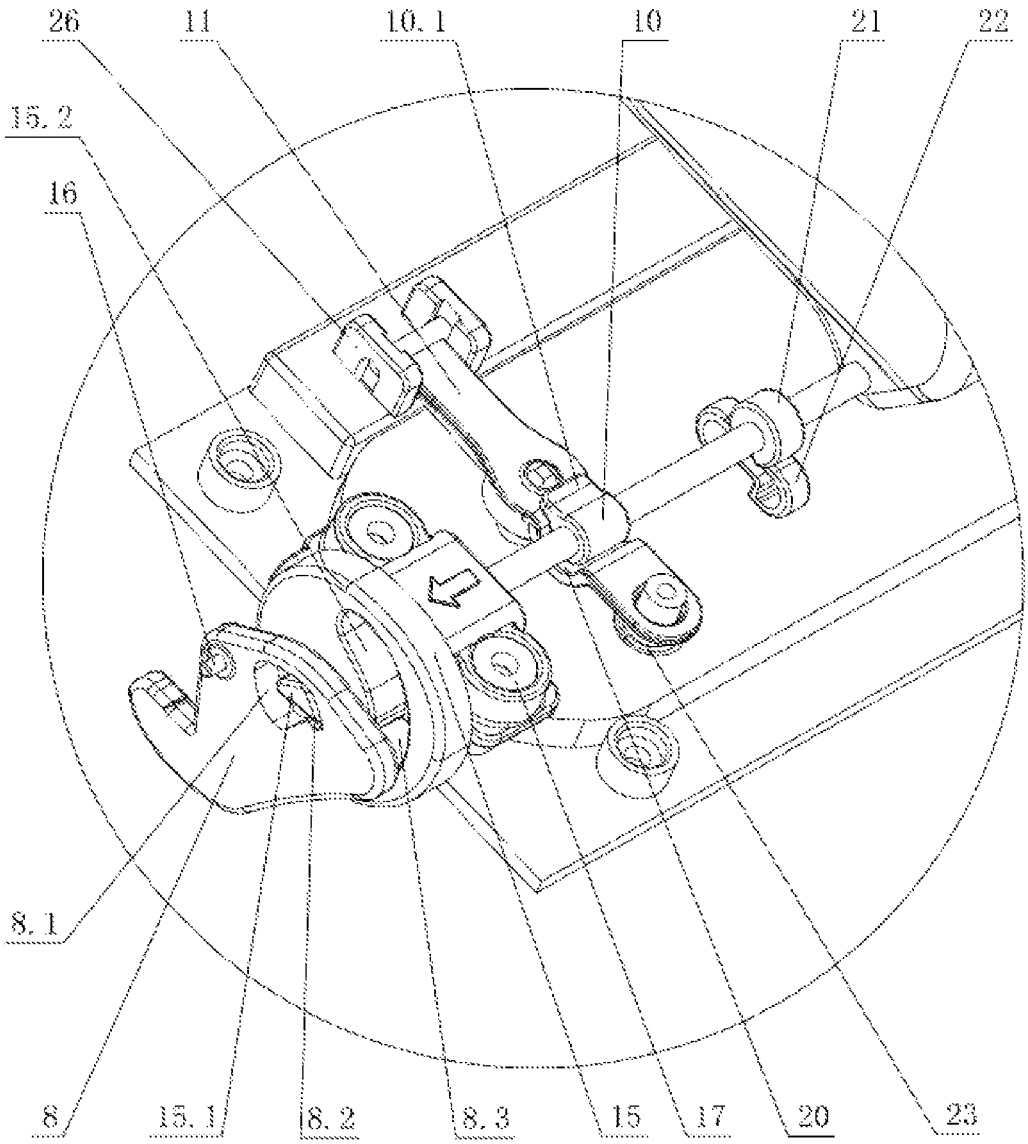
FIG. 5 is a locally enlarged structural diagram of an area A in FIG. 3.
Figure 6:
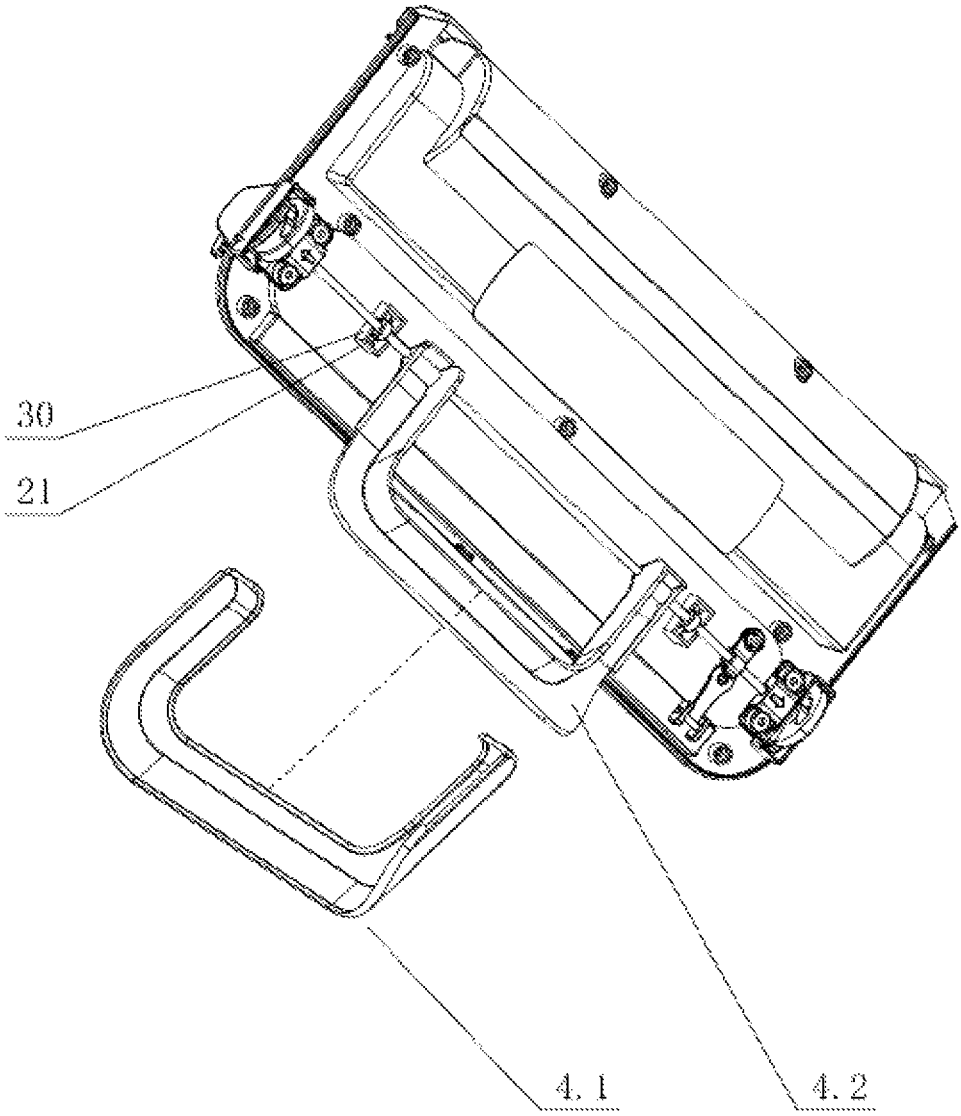
FIG. 6 is a structural diagram showing decomposed structures of the handle.
Figure 7:
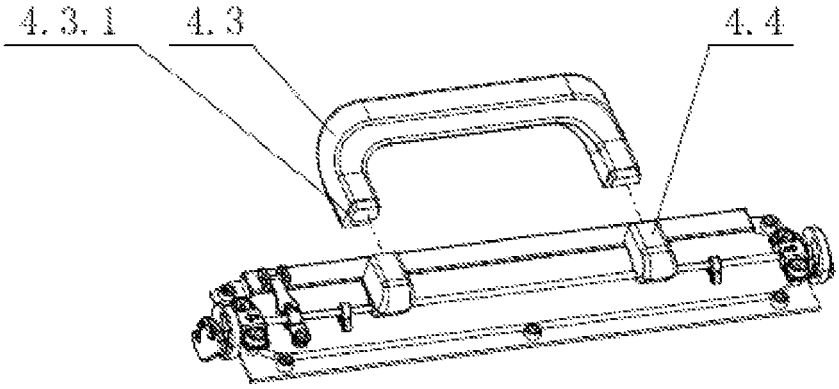
FIG. 7 is a structural diagram showing decomposed structures of the handle in another embodiment.
Figure 8:
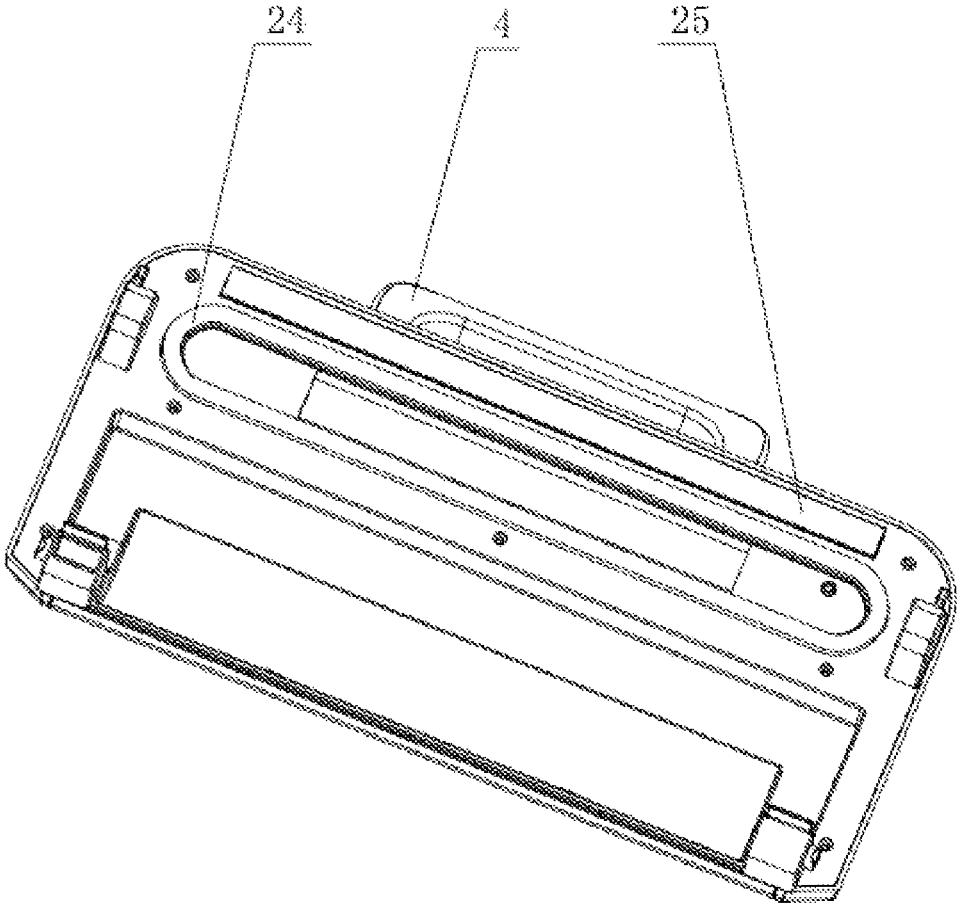
FIG. 8 is a bottom view structural diagram showing the upper casing.
Figure 9:
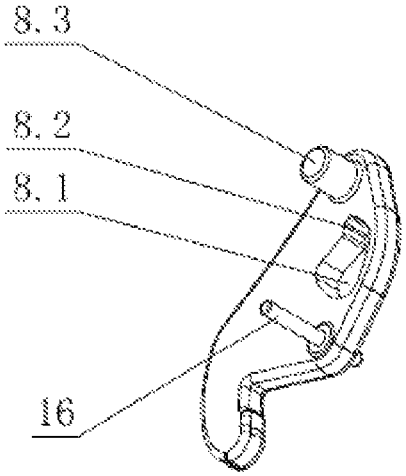
FIG. 9 is an enlarged structural diagram after assembling a locking hook and a second guiding shaft.
Figure 10:
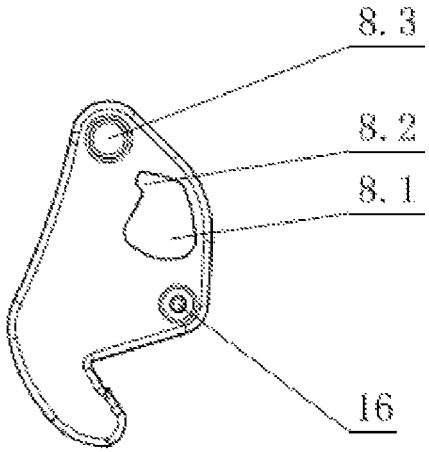
FIG. 10 is a structural diagram of a left side elevational view of FIG. 9.
Figure 11:
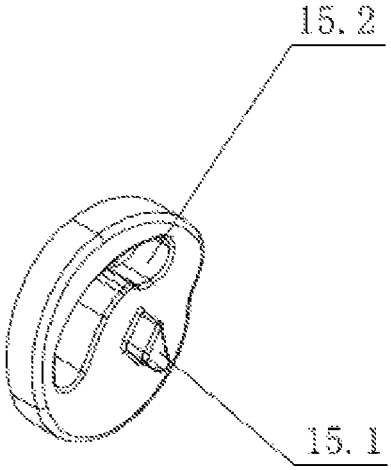
FIG. 11 is an enlarged structural diagram showing a guiding wheel.
Figure 12:
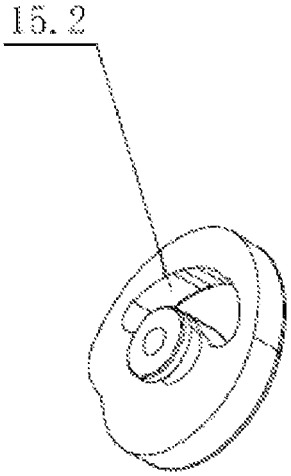
FIG. 12 is a structural diagram showing a left side elevational view of FIG. 11.

During use, the handle 4 can be divided to be structures as shown in FIG. 5, wherein the handle 4 comprises a handle outer casing 4.1 and a handle inner casing 4.2, wherein the handle inner casing 4.2 is integrally formed with the rotation shaft 9.

Or, the handle 4 comprises a base portion 4.4 connected with the rotation shaft 9, a hand lever 4.3 connected with the base portion 4.4, at least one plug 4.3.1 is provided at an end portion of the hand lever 4.3, at least one hole is correspondingly provided in the base portion 4.4, the at least one plug 4.3.1 is plugged in the at least one hole, and the base portion 4.4 and the rotation shaft 9 are integrally formed.

The sliding chute 15.2 is arc-shaped.

The at least one guiding block 15.1 is triangular or rod-shaped.

At least one auxiliary positioning pad 22 is provided on the mount pad 18, at least one auxiliary positioning wheel 21 is sleeved on the intermediate portion of the rotation shaft 9, the at least one auxiliary positioning wheel 21 is pressed on the auxiliary positioning pad 22, a locking slot is provided at a side of the auxiliary positioning wheel 21, a locking boss is provided on the at least one auxiliary positioning pad 22, and the locking boss is slidably inserted into the locking slot.

In the present embodiment, the at least one auxiliary positioning wheel 21 and the at least one auxiliary positioning pad 22 are provided to be two, and provided symmetrically.

To prevent the at least one auxiliary positioning wheel 21 and the at least one auxiliary positioning pad 22 from displacement, at least one protection sleeve 30 is provided on the mount pad 18 for positioning the at least one auxiliary positioning wheel 21 and the at least one auxiliary positioning pad 22, and the at least one protection sleeve 30 is sleeved over the at least one auxiliary positioning wheel 21 and the auxiliary positioning pad 22.

In the description of the present invention, it shall be understood that, positional or spatial relationships indicated by terms "central", "longitudinal", "transverse", "length", "width", "thickness", "upper", "lower", "front", "rear", "left". "right", "vertical", "horizontal", "top", "bottom", "inner", "outer", "clockwise" and "counterclockwise" are based on the positional or spatial relationships shown in the drawings, and are used to make it convenient to describe the present invention and ease description, rather than indicate or imply that the device or component must have a specific direction, be manufactured or operated in the specific direction, and shall not be construed as limitations on the present invention, terms "first", "second" are only used for description purpose, and shall not be deemed to imply or indicate relative importance or indicate implicitly the number of the technical feature.

In the foregoing paragraphs, the basic principles and main characteristics of the present invention and advantages of the present invention are set forth. Those skilled in the art shall readily understand that, the present invention is not limited by the foregoing embodiments, the description of the embodiments are only intended to explain the principles of the present invention, without departing from the spirit and the scope of the present invention, a variety of changes and variations can be done to the present invention, and such changes and variations fall into the protection scope of the present invention. The protection scope of the present invention is defined by the appended claims and equivalents thereof.

The invention claimed is:

1. A vacuum sealer, comprising an upper casing (1) with a first vacuum contact surface, and a lower casing (2) with a second vacuum contact surface, one side of the upper casing (1) and one side of the lower casing (2) are hinged together, wherein a projecting handle (4) is provided at another side of the upper casing (1), a mount pad (18) and a rotation shaft (9) in contact with the handle (4) are provided on the upper casing (1), the rotation shaft (9) is installed rotatably on the mount pad (18) via at least one positioning pad, the rotation shaft (9) is connected with at least one guiding wheel (15), at least one projecting guiding block (15.1) and at least one sliding chute (15.2) are provided at another side of the at least one guiding wheel (15), the at least one sliding chute (15.2) is provided in the at least one guiding wheel (15), one side of at least one locking hook (8) is hinged on the at least one positioning pad, at least one positioning slot (8.1) is provided in an intermediate portion of the at least one locking hook (8), at least one guiding block (15.1) is inserted in the at least one positioning slot (8.1), a first guiding shaft (8.3) is provided on another side of the at least one locking hook (8), the first guiding shaft (8.3) is plugged in the at least one sliding chute (15.2), at least one positioning hole (7) is provided in the lower casing (2), when pressing the handle (4) downward, the at least one guiding wheel (15) and the at least one locking hook (8) are driven to rotate so that a hook of the at least one locking hook (8) is inserted into the at least one positioning hole (7) and lock the upper casing (1) and the lower casing (2) together.

2. The vacuum sealer according to claim 1, wherein the at least one positioning pad comprises a second positioning pad (17) and a third positioning pad (18), wherein the second positioning pad (17) and the third positioning pad (18) are respectively provided at both sides of the mount pad (18), axle holes for passing the rotation shaft (9) are respectively provided in between the second positioning pad (17), the third positioning pad (19) and the mount pad (18).

3. The vacuum sealer according to claim 1, wherein at least one limiting slot (8.2) communicating with the at least one positioning slot (8.1) is provided at a rear side of the at least one positioning slot (8.1) and an end of the at least one guiding block (15.1) is abutted in the at least one limiting slot (8.2).

4. The vacuum sealer according to claim 1, wherein a vent pad (11) with one end thereof hinged on the mount pad (18) is provided on the mount pad (18), an assembly slot (20) is opened in an intermediate portion of the vent pad (11), the at least one guiding sleeve (10) is sleeved over an intermediate portion of the rotation shaft (8), a limiting plate (10.1) is provided at a side of the at least one guiding sleeve (10), the at least one guiding sleeve (10) is rotatably provided in the assembly slot (20), the limiting plate (10.1) is connected on the vent pad (11) outside the assembly slot (20), another end of the vent pad (11) is connected with at least one positioning spring (23) provided on the mount pad (18), and a vent valve is provided underneath another end of the vent pad (11).

5. The vacuum sealer according to claim 1, wherein a heating assembly (14) and a first cushion (12) are respectively provided at another side of the lower casing (2), a stopper (13) for positioning an edge of a package to be sealed is provided at an inner side or an outer side of a first cushion (12); a silicone gel sealing piece (25) and a second cushion (24) are provided on a side of the upper casing (2), the first cushion (12) corresponds to the second cushion (24); and the heating assembly (14) corresponds to the silicone gel sealing piece (25).

6. The vacuum sealer according to claim 1, wherein the handle (4) and the rotation shaft (9) are integrally formed by injection molding.

7. The vacuum sealer according to claim 1, wherein the handle (4) comprises an outer casing (4.1) and an inner casing (4.2), wherein the inner casing (4.1) of the handle (4) is integrally formed with the rotation shaft (8) by injection molding; or, the handle (4) comprises a base portion (4.4) connected with the rotation shaft (8), and a hand lever (4.3) connected with the base portion (4.4), at least one hole is provided in the base portion (4.4), at least one plug (4.3.1) is inserted in the at least one hole, and the base portion (4.4) and the rotation shaft (8) are integrally formed by injection molding.

8. The vacuum sealer according to claim 1, wherein the sliding chute (15.2) is arc-shaped.

9. The vacuum sealer according to claim 1, wherein the at least one guiding block (15.1) is triangular or rod-shaped.

10. The vacuum sealer according to claim 1, wherein at least one auxiliary positioning seat (22) is provided on the mount pad (18), at least one auxiliary positioning wheel (21) is sleeved over an intermediate portion of the rotation shaft (8), the at least one auxiliary positioning wheel (21) is connected with the at least one auxiliary positioning seat (22), and a side of the at least one auxiliary positioning wheel (21) is provided with at least one locking slot; at least one locking boss is provided on the at least one auxiliary positioning seat (22), and the at least one locking boss is slidably inserted in the at least one locking slot (21).

* * * * *